US010998669B2

(12) United States Patent
Mamiya et al.

(10) Patent No.: US 10,998,669 B2
(45) Date of Patent: May 4, 2021

(54) CONNECTOR WITH RECEPTACLE HAVING MOVING PLATE AND SEALING MEMBER MOUNTED IN THE RECEPTACLE

(71) Applicant: Sumitomo Wiring Systems, Ltd., Mie (JP)

(72) Inventors: Yuma Mamiya, Mie (JP); Shinjiro Kida, Mie (JP); Sho Saito, Mie (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/671,115

(22) Filed: Oct. 31, 2019

(65) Prior Publication Data

US 2020/0153152 A1 May 14, 2020

(30) Foreign Application Priority Data

Nov. 14, 2018 (JP) ..... JP2018-213438

(51) Int. Cl.

| | |
|---|---|
| ***H01R 13/52*** | (2006.01) |
| ***H01R 13/506*** | (2006.01) |
| ***H01R 13/447*** | (2006.01) |
| ***H01R 13/627*** | (2006.01) |

(52) U.S. Cl.

CPC ..... *H01R 13/5202* (2013.01); *H01R 13/447* (2013.01); *H01R 13/506* (2013.01); *H01R 13/6271* (2013.01)

(58) Field of Classification Search

CPC .. H01R 13/42; H01R 13/502; H01R 13/4367; H01R 13/5219; H01R 31/06; H01R 13/631

See application file for complete search history.

(56) References Cited

U.S. PATENT DOCUMENTS

| | | | | |
|---|---|---|---|---|
| 6,685,506 | B1 * | 2/2004 | Nakamura | H01R 13/631 439/595 |
| 7,168,981 | B2 * | 1/2007 | Takahashi | H01R 13/4223 439/595 |
| 2012/0149227 | A1 * | 6/2012 | Yoshida | H01R 13/5202 439/277 |
| 2015/0147918 | A1 * | 5/2015 | Matsuda | H01R 13/5841 439/694 |
| 2015/0255939 | A1 * | 9/2015 | Myer | H01R 31/06 439/655 |

FOREIGN PATENT DOCUMENTS

| | | |
|---|---|---|
| JP | 2003-068401 | 3/2003 |

* cited by examiner

*Primary Examiner* — Jean F Duverne
(74) *Attorney, Agent, or Firm* — Gerald E. Hespos; Michael J. Porco; Matthew T. Hespos

(57) ABSTRACT

It is aimed to mount a sealing member into a receptacle after arranging a moving plate in the receptacle. In a fitting space (28) of a receptacle (25), plate lock portions (44) are provided to project, a moving plate (14) to be locked by the plate locks (44) at a protecting position is arranged, and a sealing member (16) is arranged closer to an opening than the plate locks (44). The receptacle (25) is composed of a body-side receptacle (30) including the plate locks (44) and a tip-side receptacle (31) arranged closer to the opening of the fitting space (28) than the body-side receptacle (30) and to be coupled to the body-side receptacle (30). The sealing member (16) is fixed by being sandwiched between the body-side receptacle (30) and the tip-side receptacle (31).

9 Claims, 15 Drawing Sheets

CONNECTOR WITH RECEPTACLE HAVING MOVING PLATE AND SEALING MEMBER MOUNTED IN THE RECEPTACLE

BACKGROUND

Field of the Invention

The invention relates to a connector.

Related Art

Japanese Unexamined Patent Publication No. 2003-68401 discloses a male connector with male terminal fittings including tabs, a receptacle arranged such that the tabs project therein and a moving plate arranged movably in the receptacle to position and protect tips of the tabs at an initial position (protecting position).

A female connector is provided to connect with the male connector and includes a female connector housing having a body that can fit into the moving plate. An annular sealing member is fit on the outer periphery of the body such that an outer surface of the sealing member closely contacts the inner surface of the receptacle, and an inner surface of the sealing member closely contacts the outer surface of the body. Thus, the male and female connectors are connected in a liquid-tight manner via the sealing member.

The female connector has been structured to allow enlargement in a radial direction perpendicular to a connecting direction. However, a female connector may have to be inserted into a hole in a panel during assembling and must be smaller in the radial direction to avoid interference with the panel. The female connector can be smaller in the radial direction by mounting the sealing member in the receptacle rather than in the female connector housing.

A lock structure normally is provided on the inner surface of the receptacle for holding the moving plate at the initial position. Additionally, if the sealing member is mounted in the receptacle, a pedestal must be provided apart from this lock structure for holding the sealing member in the receptacle. Thus, it has been difficult to design a mold.

The invention was completed in view of the above situation to provide a connector enabling a sealing member to be mounted into a receptacle after arranging a moving plate in the receptacle.

SUMMARY

The invention is directed to a connector with a male terminal fitting including a tab and a receptacle including a fitting space. The tab projects into the fitting space. A plate lock is provided in the receptacle to project into the fitting space. A moving plate is arranged in the fitting space and can move from a protecting position to a retracted position. The plate lock can lock the moving plate in a movement restricted state at the protecting position where the moving plate positions and protects a tip of the tab. A sealing member is arranged in the fitting space at a position closer to an opening of the fitting space than the moving plate. An outer surface of the sealing member closely contacts an inner surface of the receptacle, and an inner surface of the sealing member closely contacts an outer surface of a mating female housing. The receptacle is composed of a body-side receptacle and a tip-side receptacle. The body-side receptacle includes the plate lock. The tip-side receptacle is closer to the opening of the fitting space than the body-side receptacle and is coupled to the body-side receptacle. The sealing member is fixed by being sandwiched between the body-side receptacle and the tip-side receptacle.

The plate lock that locks the moving plate is provided in the receptacle. Thus, it is difficult to provide a pedestal for holding the sealing member in the receptacle. However, the receptacle is composed of the body-side receptacle including the plate lock and the tip-side receptacle, and the sealing member is fixed by being sandwiched between the body-side receptacle and the tip-side receptacle. Thus the sealing member is mounted into the receptacle without trouble regardless of the shape and arrangement of the plate lock.

The body-side receptacle or the tip-side receptacle may have a ring locking portion. Additionally, the sealing member may have a plate-like locking piece projecting radially out of a body part of the sealing member and to be locked to the ring locking portion. The body-side receptacle and the tip-side receptacle are held in a coupled state by coupling arms arranged on both widthwise sides across the locking piece. According to this configuration, the locking piece can be positioned on the both widthwise sides by the coupling arms. Thus, a locked state of the locking piece and the ring locking portion can be maintained stably.

The ring locking portion may have a locking protrusion, and the locking piece may have a bottomed or bottomless lock receiving portion. The locking protrusion is positioned and inserted into the lock receiving portion. Thus, the locked state of the locking piece and the ring locking portion can be maintained more stably and reliably.

The tip-side receptacle includes a lock portion configured to lock the female housing and hold the female housing in a connected state. Thus, the tip-side receptacle is not a dedicated component and the body-side receptacle need not have the lock. Thus, a degree of freedom in the configuration of the body-side receptacle can be enhanced.

DETAILED DESCRIPTION

Figure 1:
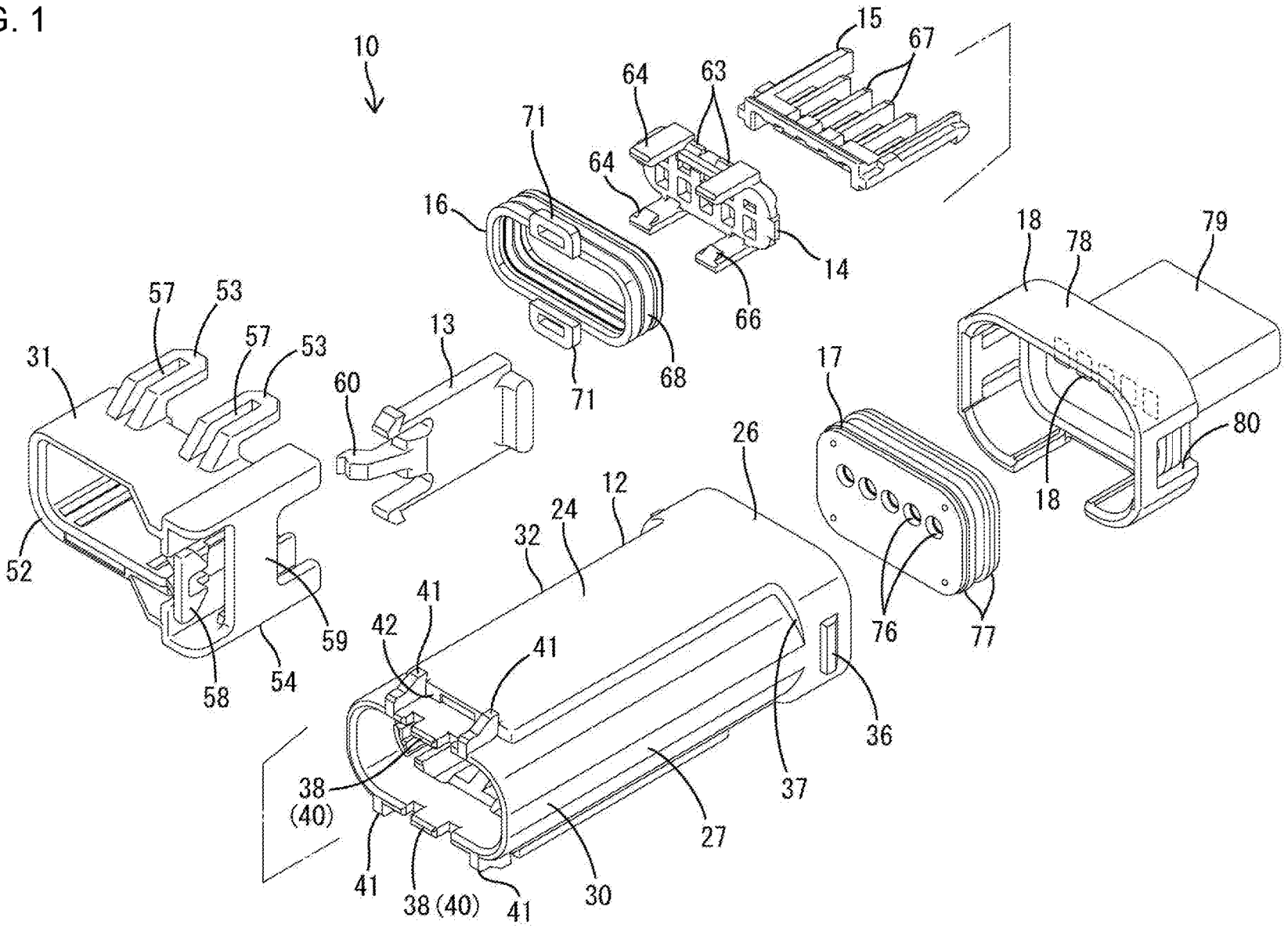
FIG. 1 is an exploded perspective view of a male connector in one embodiment of the present invention.
Figure 3:
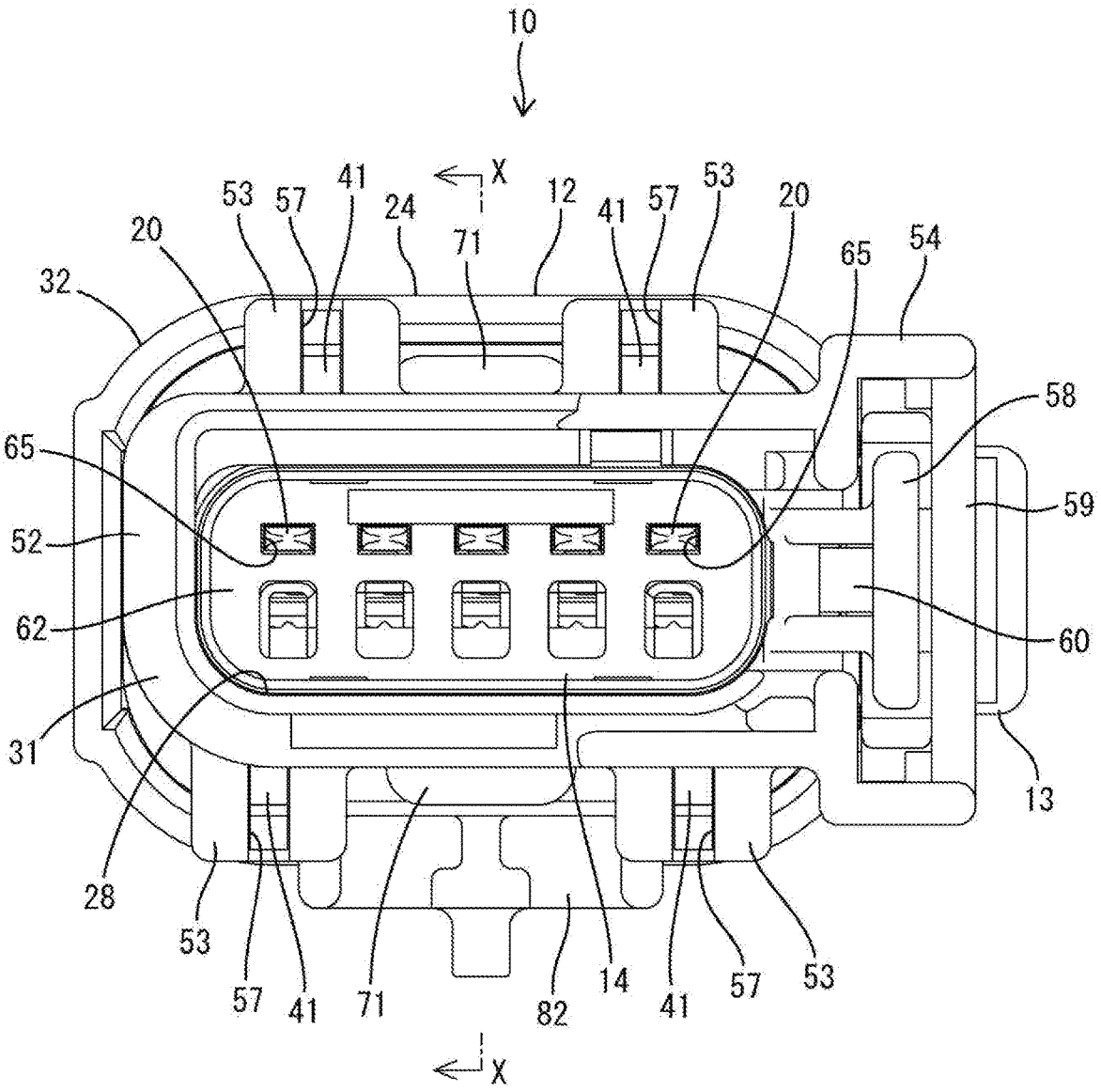
FIG. 3 is a front view of the male connector.
Figure 4:
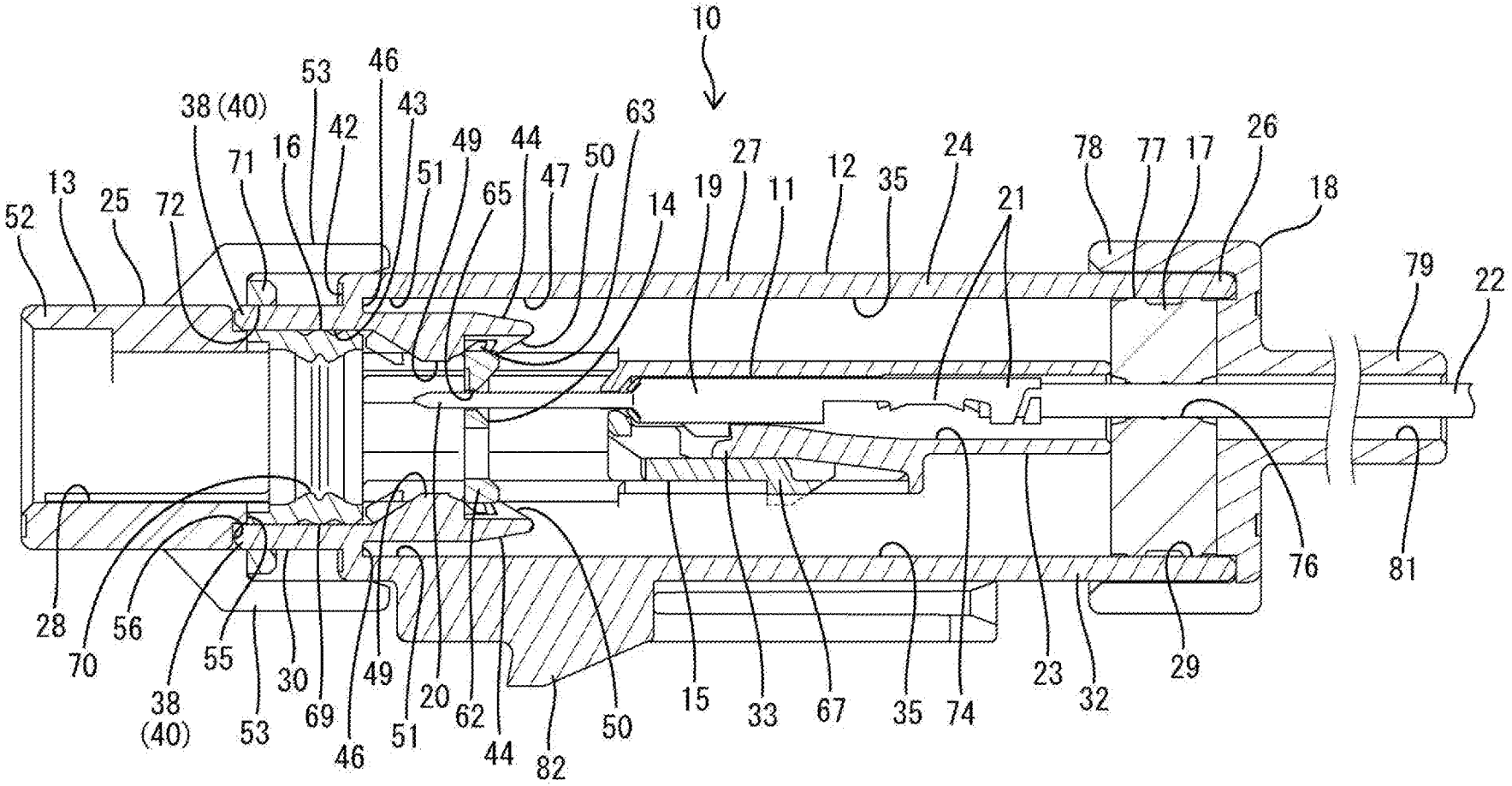
FIG. 4 is a section along X-X of FIG. 3.
Figure 10:
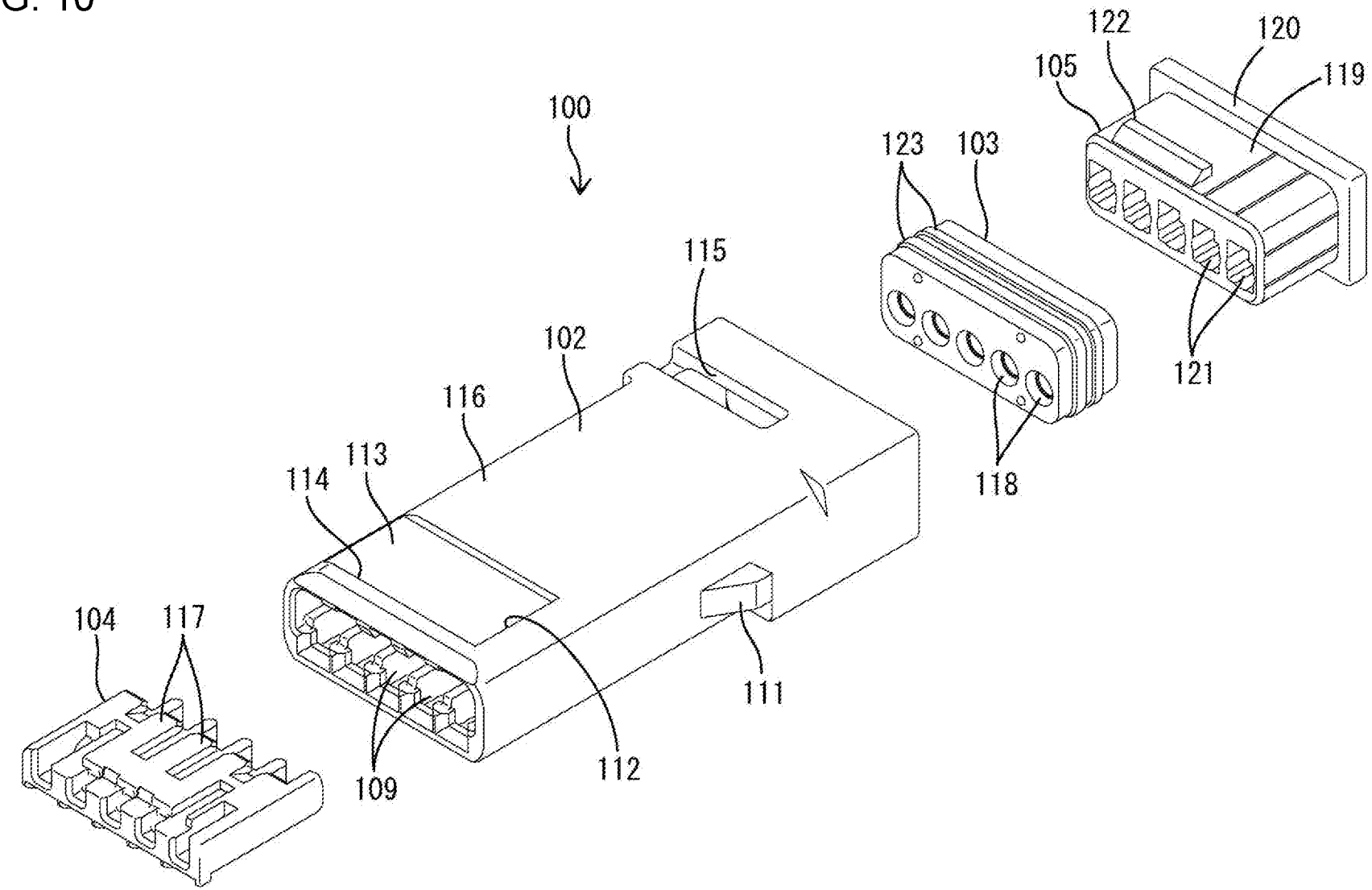
FIG. 10 is an exploded perspective view of a female connector.
Figure 11:
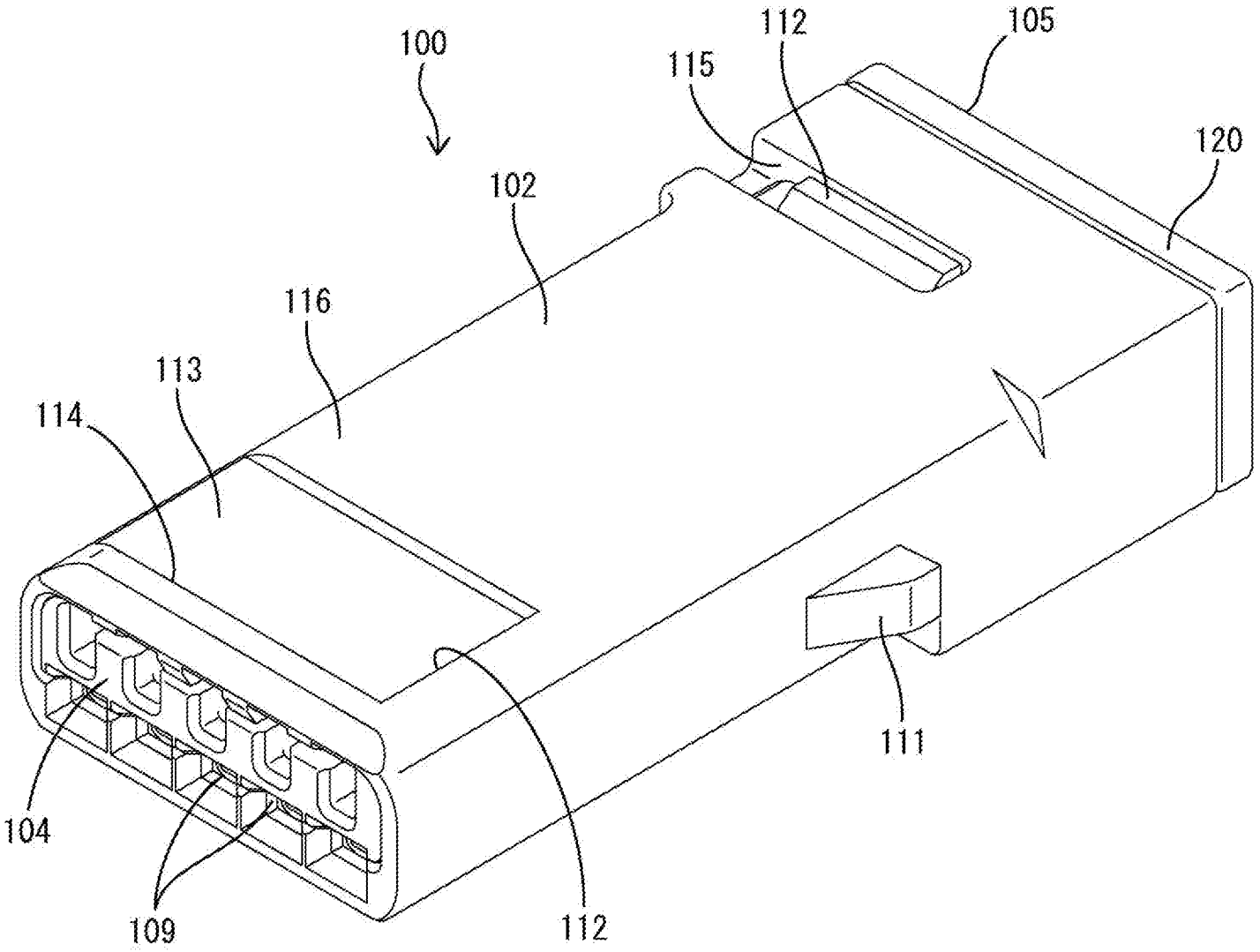
FIG. 11 is a perspective view of the female connector.
Figure 14:
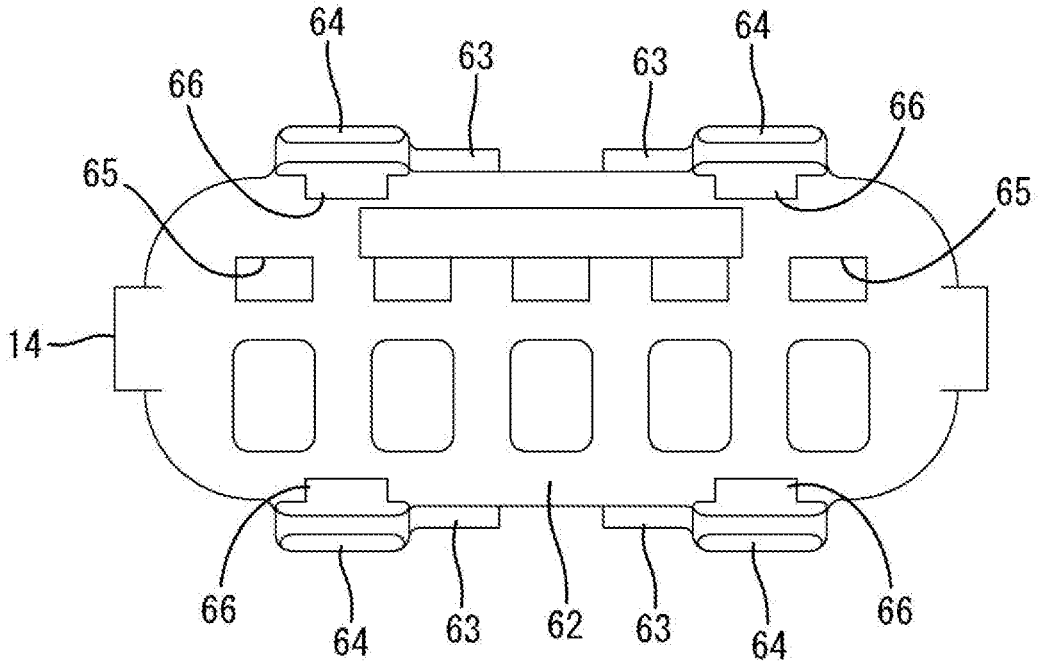
FIG. 14 is a front view of the moving plate.
Figure 15:
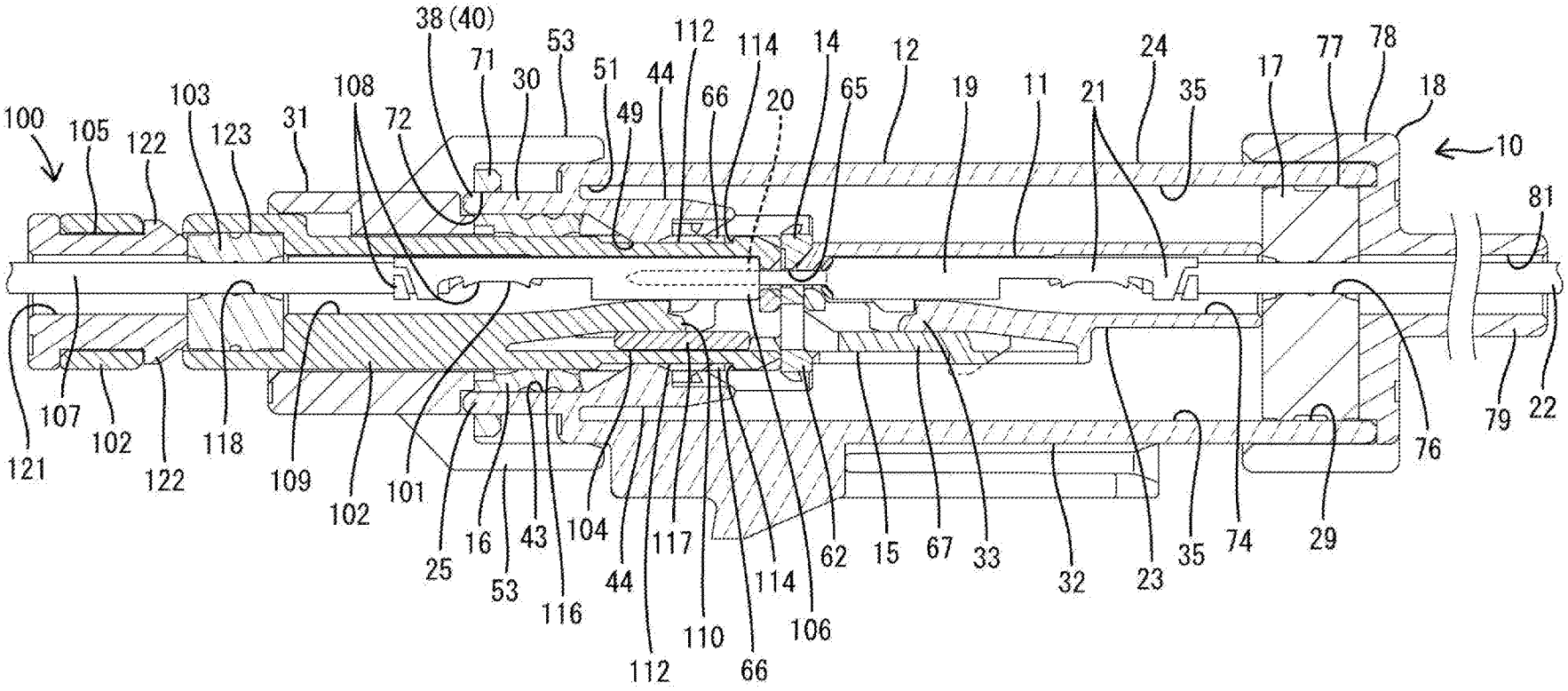
FIG. 15 is a side view in section of the both connectors in a connected state.
Figure 16:
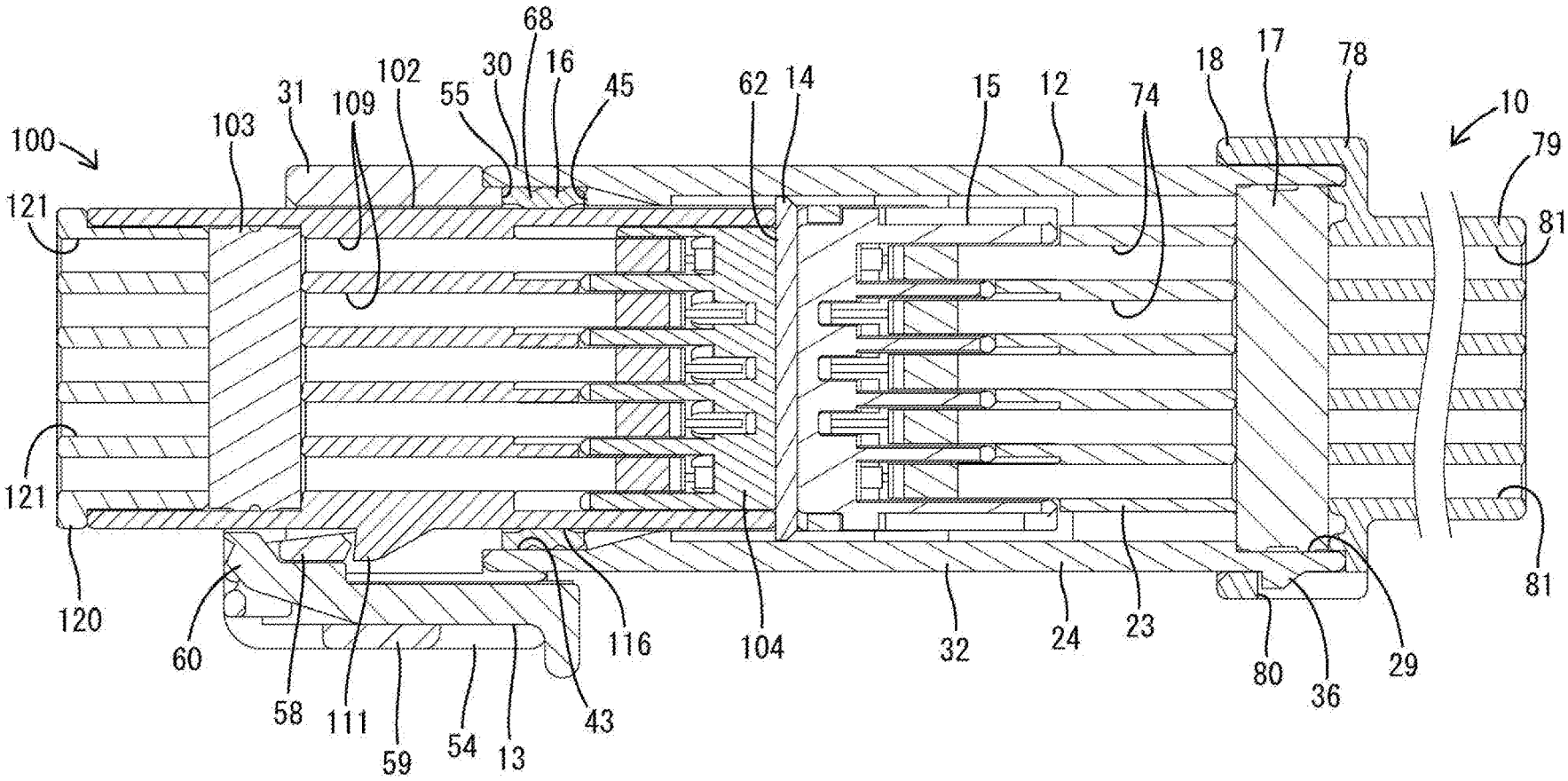
FIG. 16 is a plan view in section of the both connectors in the connected state.

An embodiment of the invention is described with reference to FIGS. 1 to 16. As shown in FIGS. 15 and 16, this embodiment is composed of a male connector 10 and a female connector 100 connectable to and separable from each other. As shown in FIGS. 1 and 4, the male connector 10 includes male terminal fittings 11, a male housing 12, a detecting member 13, a moving plate 14, a retainer 15, a sealing member 16, a sealing plug 17 and a rear holder 18. As shown in FIGS. 10, 11 and 15, the female connector 100 includes female terminal fittings 101, a female housing 102, a retainer 104, a sealing plug 103 and a rear holder 105. The retainer 15, the sealing plug 17 and the rear holder 18 of the male connector 10 are different in shape from the retainer 104, the sealing plug 103 and the rear holder 105 of the female connector 100. However, the same terms are given since these components exhibit substantially the same functions. The same terms are given to other structures if substantially the same functions are exhibited. Note that, in the following description, surface of the connectors 10, 100 facing each other at the start of connection are referred to as front ends concerning a front-rear direction, and a vertical direction is based on a vertical direction of FIG. 15. An exploded perspective view of the male connector 10 shown in FIG. 1 is based on the vertical direction, but an exploded perspective view of the female connector 100 shown in FIG. 10 and a perspective view of the female connector 100 of FIG. 11 are inverted in the vertical direction. A lateral direction is a lateral direction of FIG. 3 and synonymous with a width direction.

Female Terminal Fittings 101

The female terminal fitting 101 is formed, such as by bending a conductive metal plate, and is elongated in the front-rear direction. A tubular connecting portion 106 is formed in a front part the female terminal fitting 101, as shown in FIG. 15, and a later-described tab 20 of the male terminal fitting 11 is inserted and connected to the connecting portion 106 at the time of connecting the connectors 10, 100. A barrel 108 is formed at a rear part of the female terminal fitting 101 and is to be connected electrically and mechanically to an end part of a wire 107.

Female Housing 102

The female housing 102 is made of synthetic resin and, as shown in FIGS. 10 and 11, has a flat shape thin in the vertical direction and extending along the width direction to define a substantially rectangular shape somewhat longer in the front-rear direction in a plan view. Cavities 109 penetrate the female housing 102 in the front-rear direction. The cavities 109 are arranged side by side in a row in the width direction, as shown in FIG. 16, and locking lances 110 project on inner wall lower surfaces, as shown in FIG. 15. A female terminal fitting 101 is inserted into each cavity 109 and is held in the cavity 109 by engagement of the locking lance 110 with the connecting portion 106.

A claw-like lock receiving portion 111 is provided slightly behind a center in the front-rear direction on a side surface of the female housing 102. As shown in FIG. 16, the lock receiving portion 111 is locked to a lock 58 on the male housing 12 and functions to hold the connectors 10, 100 in a connected state.

Shallow recesses 112 are provided in upper and lower surfaces of the female housing 102 and are substantially rectangular in upper and lower plan views. As shown in FIGS. 10 and 11, each recess 112 has a flat bottom surface 113 defined by front and rear edges along the width direction and one side edge along the front-rear direction. One side edge of each recess 112 is near the side surface of the female housing 102 where the lock receiving portion 111 is provided. The other side facing the one side edge of the recess 112 is open. As shown in FIG. 15, a locking edge 114 is defined at the front of the recess 112 and extends vertically along the depth direction of the recess 112 for locking a later-described locking projections 66 of the moving plate 14. Two of the recesses 112 are vertically symmetrical in the upper and lower surfaces of the female housing 102.

As shown in FIGS. 10 and 11, laterally extending holder lock grooves 115 are provided in the upper and lower surfaces of the female housing 102 at positions behind the recesses 112. The holder lock grooves 115 are positioned eccentrically in the width direction and are open on extending ends. The holder lock grooves 115 are vertically symmetrical in the upper and lower surfaces of the female housing 102. Later-described holder locks 122 of the rear holder 105 are inserted into the holder lock grooves 115 to be locked.

The outer surface of the female housing 102 has a sealing surface 116 continuous in a circumferential direction without any step between the recesses 112 and the lock receiving portion 111 in the front-rear direction. The sealing surface 116 is composed of flat surfaces (upper surface, lower surface and side surfaces) and curved surfaces (four corner surfaces) alternately arranged in the circumferential direction, and is held in close contact with the inner surface of the sealing member 16 when the connection of the connectors 10, 100 is completed, as shown in FIG. 15.

Retainer 104 of Female Connector 100

The retainer 104 is made of synthetic resin, has a wide flat shape, as shown in FIG. 10, and is accommodated entirely into a lower space of a front part of the female housing 102 (see FIG. 15). The retainer 104 includes plate-like detecting pieces 117 at positions corresponding to the respective cavities 109. A locking lance 110 remains deflected if a female terminal fitting 101 is not inserted properly into the cavity 109 and interferes with the detecting piece 117 to restrict mounting of the retainer 104 into the female housing 102, thereby indicating that a female terminal fitting 101 is not inserted completely. On the other hand, if the female terminal fittings 101 are inserted properly into the cavities 109, the retainer 104 is mounted properly into the female housing 102 and, as shown in FIG. 15, the detecting pieces 117 enter deflection spaces for the locking lances 110 to restrict deflection of the locking lances 110 and secondarily retain the female terminal fittings 101.

Sealing Plug 103 of Female Connector 100

The sealing plug 103 is made unitarily of rubber, such as silicon rubber, and, as shown in FIG. 10, in the form of a wide mat having a predetermined thickness in the front-rear direction. Sealing holes 118 penetrate the sealing plug 103 in the front-rear direction and are arranged side by side in a row in the width direction at positions corresponding to the respective cavities 109. As shown in FIG. 15, the wire 107 connected to the female terminal fitting 101 is inserted into the sealing hole 118 and is held resiliently in close contact with lips formed on the inner surface of the sealing hole 118 in a liquid-tight manner. Outer peripheral lips 123 are arranged side by side in the front-rear direction on the outer surface of the sealing plug 103. When the sealing plug 103 is accommodated into a rear part of the female housing 102, an inner surface of the female housing 102 is held resiliently in close contact with the respective outer peripheral lips 123 to hold the inside of the female housing 102 in a liquid-tight manner.

Rear Holder 105 of Female Connector 100

The rear holder 105 is made of synthetic resin and, as shown in FIG. 10, is composed of a wide block-shaped holder body 119 and a flange 120 protruding out over the entire circumference from the rear end of the holder body 119. The flange 120 is in the form of a plate substantially rectangular in a front view. A worker can connect and separate the connectors 10, 100 while placing fingers on the flange 120.

The holder body 119 is accommodated entirely in the rear part of the female housing 102. Through holes 121 penetrate the holder body 119 in the front-rear direction at positions corresponding to the cavities 109 and the sealing holes 118. Each female terminal fitting 101 is inserted into the cavity 109 successively via the through hole 121 and the sealing hole 118 during assembling. The wire 107 is inserted loosely through each through hole 121 of the holder body 119. The holder locks 122 are laterally extending ribs on the upper and lower surfaces of the holder body 119 at positions eccentric in the width direction. Two of the holder locks 122 are vertically symmetrical on the upper and lower surfaces of the holder body 119. The holder locks 122 are inserted and locked in the holder lock grooves 115 to hold the rear holder 105 in the female housing 102 while retaining the sealing plug 103. With the rear holder 105 held in the female housing 102, the holder locks 122 are accommodated in the holder lock grooves 115 without projecting from the holder lock grooves 115, as shown in FIG. 11, and an outer periphery of the flange 120 is arranged along an outer periphery of the female housing 102 substantially without any step.

Female Connector 100

As described above, the female connector 100 is structured such that the female terminal fittings 101, the retainer 104, the sealing plug 103 and the rear holder 105 are inside the female housing 102 and, as shown in FIG. 11, has no part projects significantly is out from the outer surface of the female housing 102 except the laterally projecting lock receiving portion 111 and is slim in a direction perpendicular to a connecting direction. Thus, the female connector 100 can respond to a request for miniaturization and can be inserted into a panel through hole or a small space with a limited radial dimension.

Male Terminal Fittings 11

The male terminal fitting 11 is formed, such as by bending a conductive metal plate, and elongated in the front-rear direction. As shown in FIG. 4, the male terminal fitting 11 includes a tubular terminal body 19, the tab 20 projecting forward of the terminal body portion 19 and a barrel 21 connected behind the terminal body 19. The barrel 21 is connected electrically and mechanically to an end part of a wire 22.

Male Housing 12

The male housing 12 is made of synthetic resin and, as shown in FIG. 4, is composed of a flat housing body 23 and an outer peripheral portion 24 outward of the housing body 23. The outer peripheral portion 24 is a flat tube long in the front-rear direction and is composed of a receptacle 25 arranged in a front part, an accommodating tube 26 arranged in a rear part and an intermediate portion 27 linking the receptacle 25 and the accommodating tube 26. A forwardly open fitting space 28 is defined inside the receptacle 25, and the female housing 102 is fit therein from the front. The inside of the accommodating tube 26 forms a rearwardly open accommodation space 29 for receiving the sealing plug 17 from behind.

The receptacle 25 is separable into a body-side receptacle 30 and a tip-side receptacle 31. Parts except the tip-side receptacle 31, i.e. the housing body 23, the body-side receptacle 30, the intermediate portion 27 and the accommodating tube 26, are configured inseparably as an integral housing unit 32.

Figure 5:
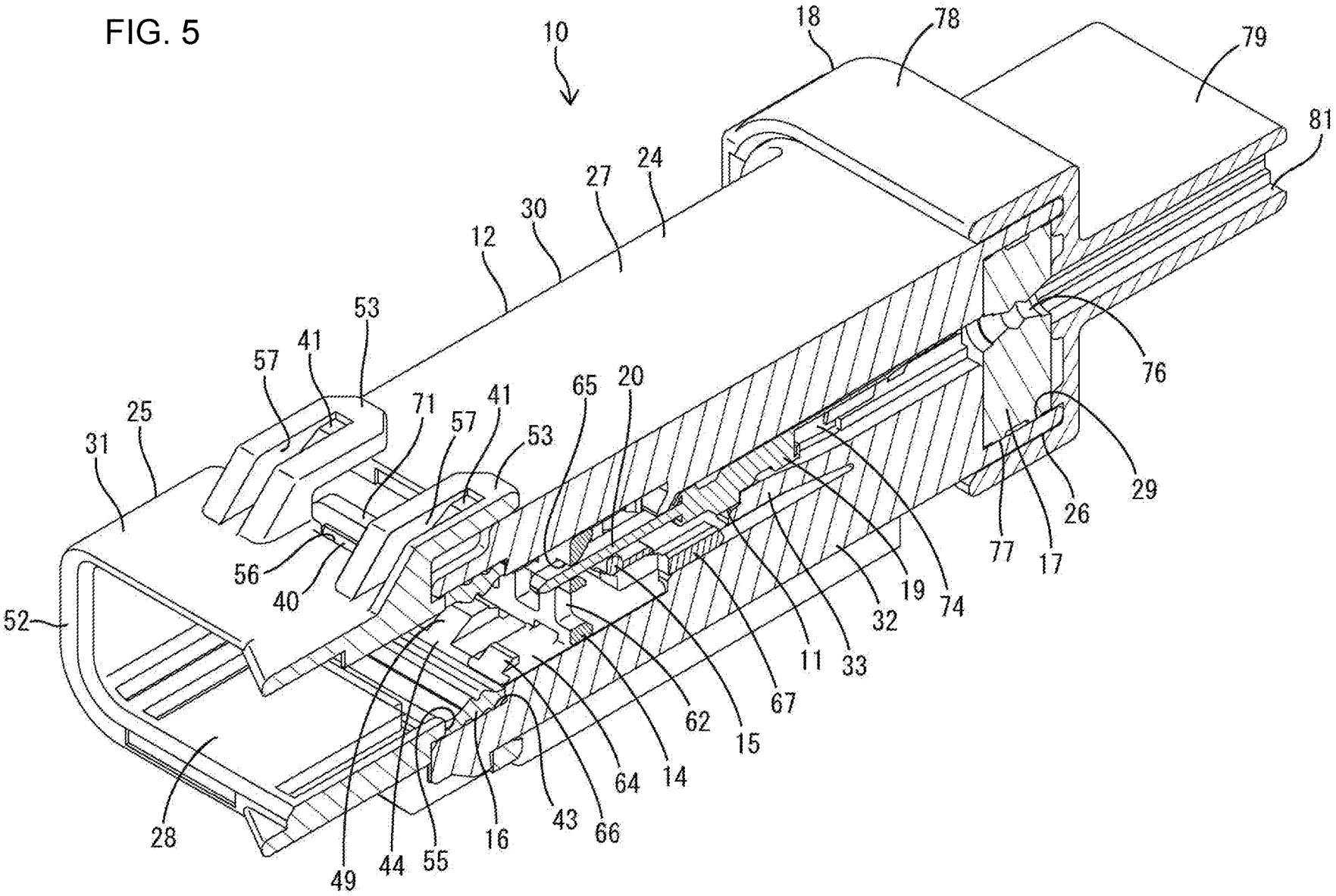
FIG. 5 is a perspective view in section of the male connector along a front-rear direction when a moving plate is at a protecting position.
Figure 7:
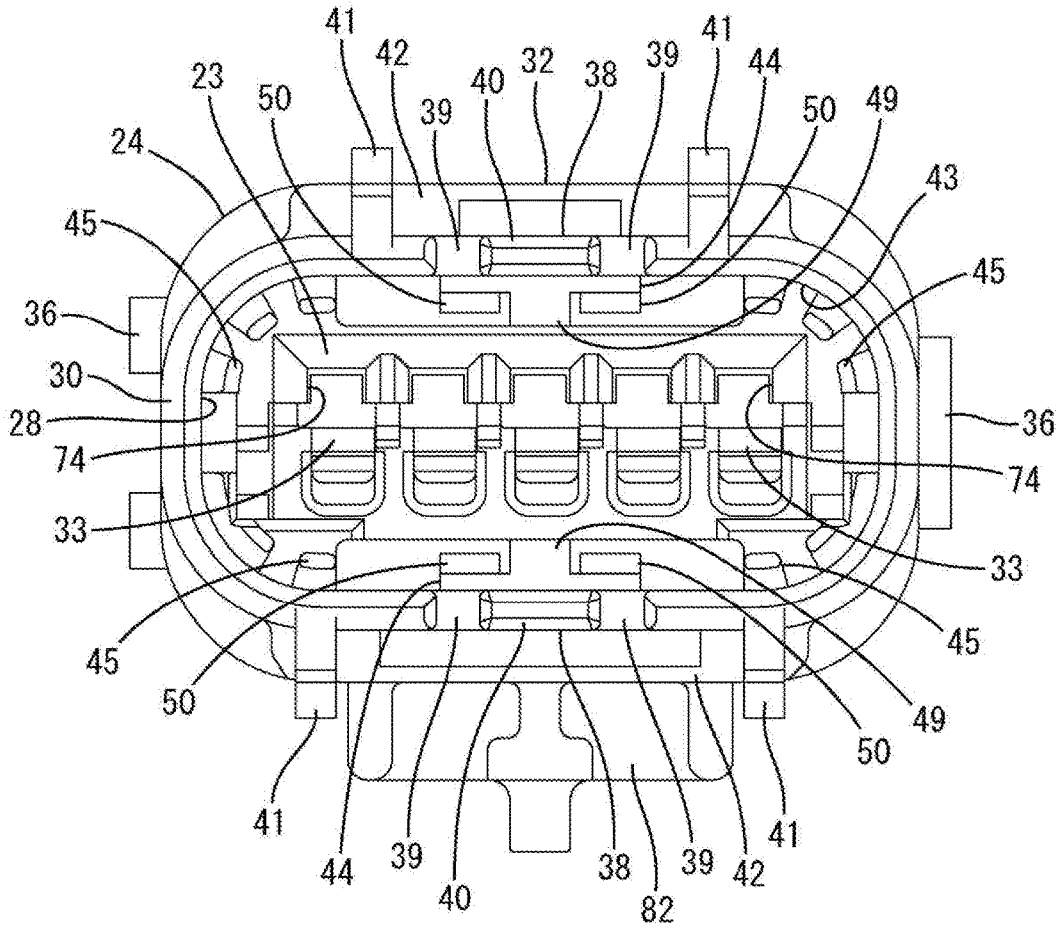
FIG. 7 is a front view of a housing unit.
Figure 8:
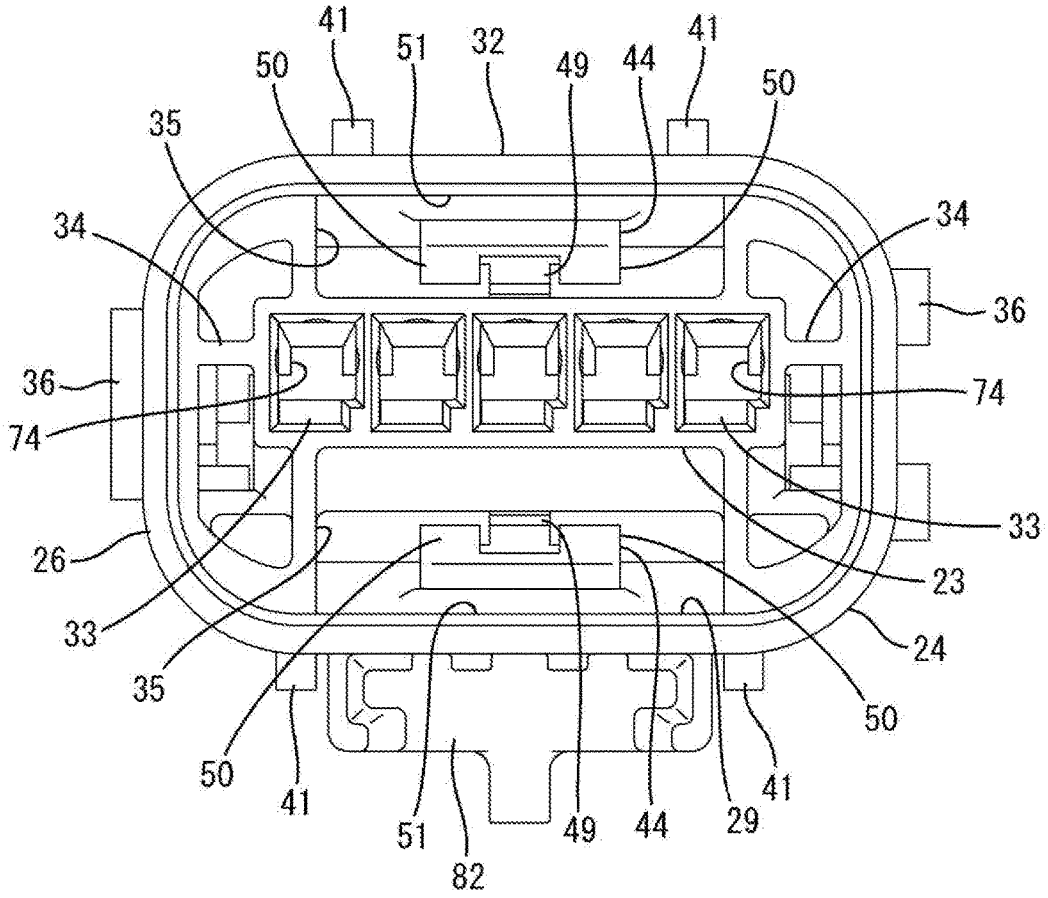
FIG. 8 is a back view of the housing unit.

Cavities 74 penetrate the housing body 23 in the front-rear direction, as shown in FIGS. 7, 8 and 16. The cavities 74 are arranged laterally in a row and, as shown in FIGS. 4 and 5, locking lances 33 project on inner wall lower surfaces. The male terminal fitting 11 is inserted into each cavity 74 and is held in the cavity 74 by engagement of the locking lance 33 with the terminal body 19.

As shown in FIG. 8, the housing unit 32 includes left and right couplings 34 between the housing body 23 and the intermediate portion 27. The housing body 23 and the intermediate portion 27 are coupled via the couplings 34. The housing unit 32 includes upper and lower communication spaces 35 between the couplings 34, as shown in FIG. 4. Each communication space 35 is a flat slit long in the width direction and extends in the front-rear direction over the entire length of the housing body 23 (also the intermediate portion 27). The front end of each communication space 35 communicates with the fitting space 28 and the rear end thereof communicates with the accommodation space 29. Upper and lower sides of the housing unit 32 are hollow in the front-rear direction via the fitting space 28, the communication spaces 35 and the accommodation space 29 except at positions where later-described plate locks 44 are formed.

Figure 9:
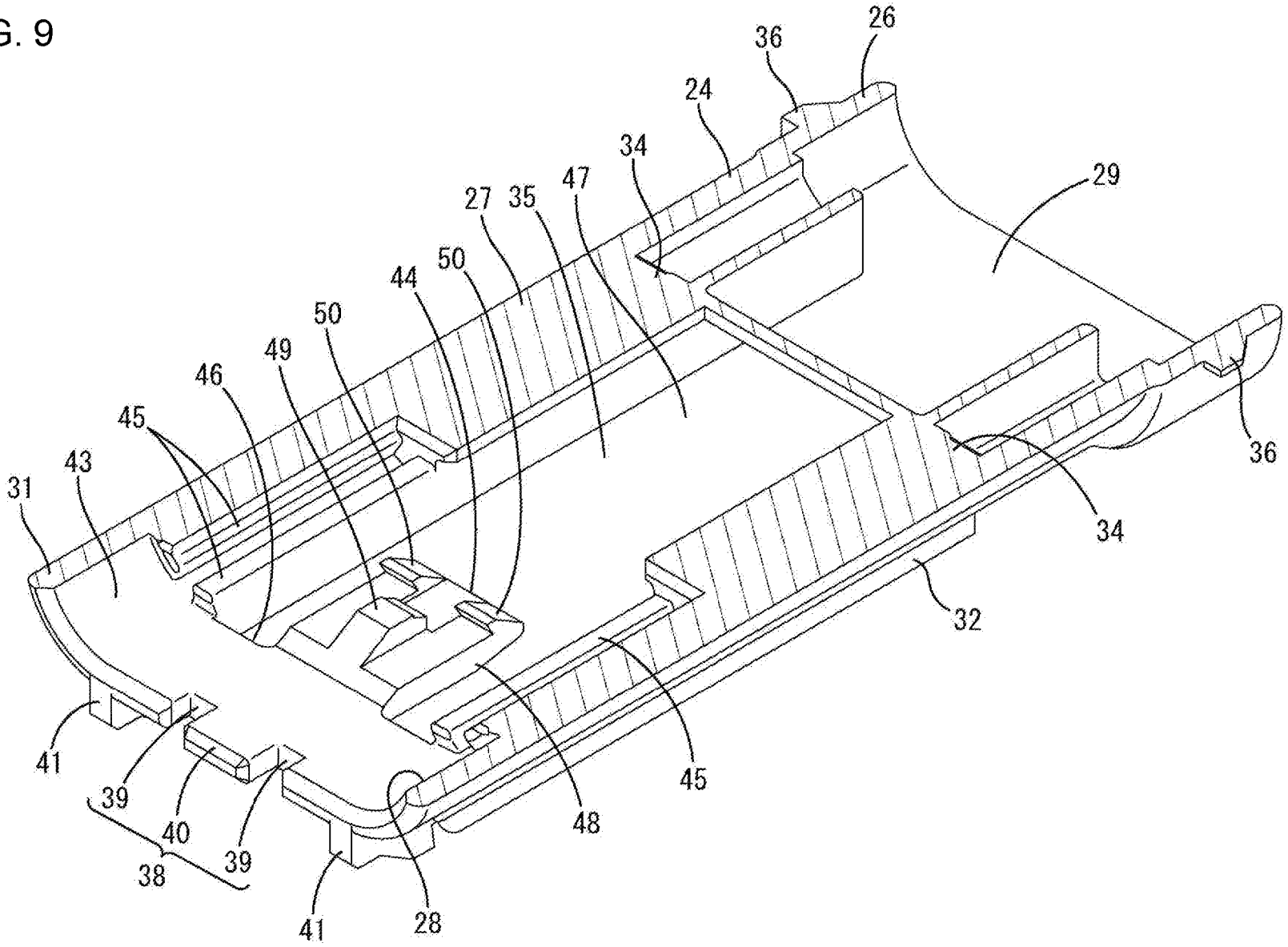
FIG. 9 is a perspective view in horizontal section of the housing unit.

As shown in FIGS. 8 and 9, the outer peripheral portion 24 includes claw-like holder locks 36 projecting toward both sides on outer left and right surfaces of the accommodating tube 26. As shown in FIG. 1, the outer upper and lower surfaces of the outer peripheral portion 24 are flat and continuous without any step from the accommodating tube 26 to a position near the front end of the body-side receptacle 30 (stepped surfaces 42 described later). Outer left and right side surfaces of the outer peripheral portion 24 include steps 37 between the accommodating tube 26 and the intermediate portion 27, are slightly dropped to the intermediate portion 27 from the accommodating tube 26 via the steps 37 and are continuous without a step from the intermediate portion 27 to the tip of the body-side receptacle 30.

As shown in FIG. 7, the outer peripheral portion 24 includes upper and lower ring locking portions 38 in laterally central parts of the upper and lower walls of the body-side receptacle 30. As shown in FIG. 4, the ring locking portions 38 position and lock the sealing member 16 to the front end of the body-side receptacle 30. As shown in FIGS. 7 and 9, the ring locking portion 38 is composed of slits 39 extending in the front-rear direction while being laterally spaced apart and open in the front end of the upper or lower wall of the body-side receptacle 30, and a locking protrusion 40 in the form of a rectangular plate cantilevered forward between the left and right slits 39. The ring locking portions 38 are formed within a thickness range of the upper and lower walls of the body-side receptacle 30.

Figure 2:
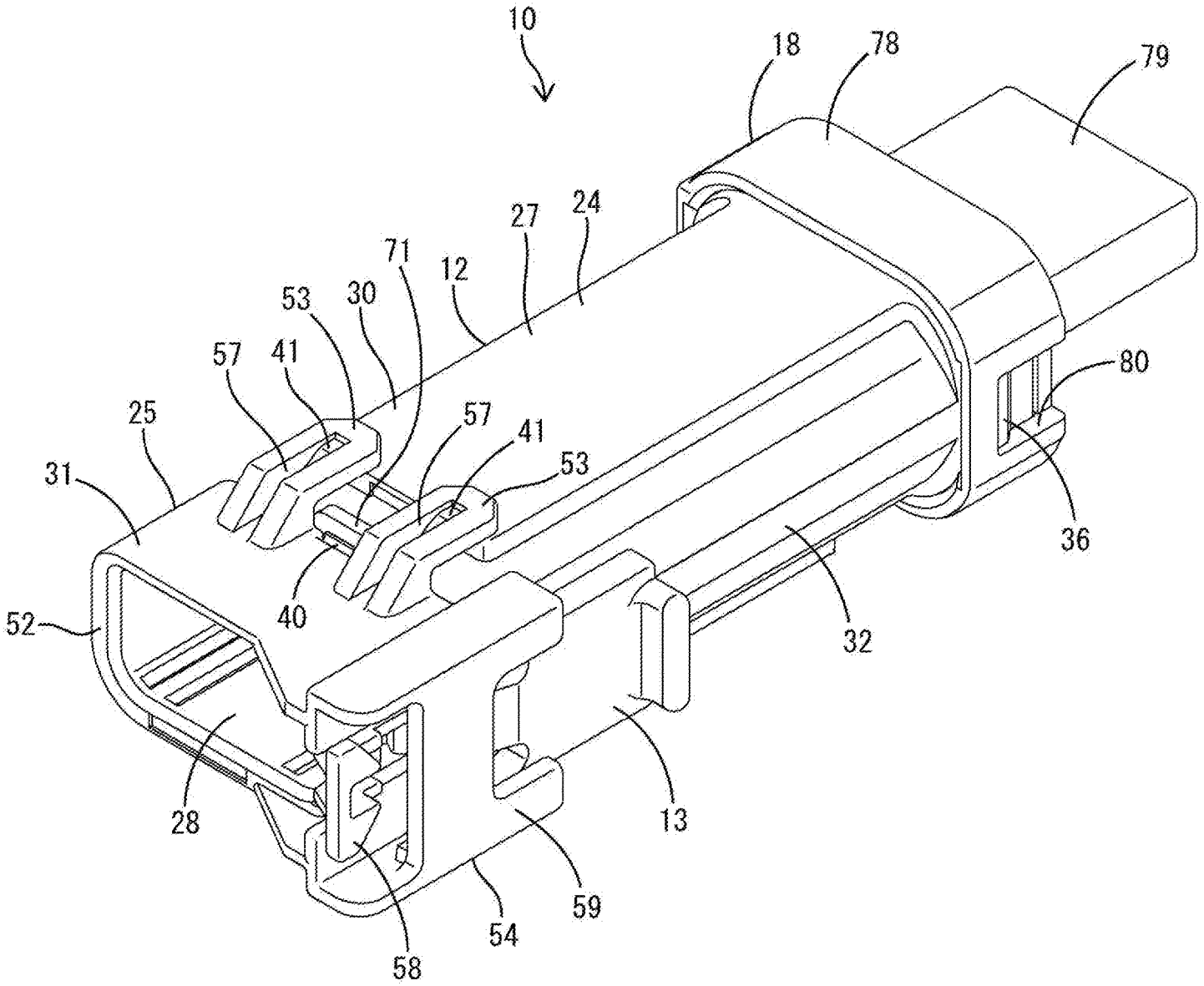
FIG. 2 is a perspective view of the male connector.

As shown in FIGS. 1 and 7, two plate-like coupling projections 41 project on left and right sides across the ring locking portion 38 on the outer surface of each of the upper and lower walls of the body-side receptacle 30. The coupling projections 41 are arranged along the front-rear direction with plate surfaces facing in the lateral direction, and lockable to later-described coupling arms 53 of the tip-side receptacle 31 as shown in FIGS. 2 and 3. Further, as shown in FIGS. 1 and 7, the stepped surfaces 42 integrally connected to the rear ends of the respective coupling projections 41 are provided along the width direction on the outer surfaces of the upper and lower walls of the body-side receptacle 30. The ring locking portions 38 are arranged while being slightly dropped from the flat upper and lower surfaces of the housing unit 32 via the stepped surfaces 42.

The inner surface of the body-side receptacle 30 includes a sealing surface 43 continuous without any step in a circumferential direction in a front part, as shown in FIG. 4, upper and lower plate locks 44 in laterally central parts of the upper and lower surfaces behind the sealing surface 43 and temporary pedestals 45 arranged at intervals in the circumferential direction between the upper and lower plate locks 44, as shown in FIG. 7.

As shown in FIG. 4, the sealing surface 43 is arranged in a range overlapping the ring locking portions 38 in the front-rear direction, and the outer surface of the sealing member 16 is held in close contact with the sealing surface 43. The inner surface of the outer peripheral portion 24 includes steps 46 on boundary parts defining the rear end of the sealing surface 43 on upper and lower surfaces, and has a flat continuous surface 47 slightly dropped from the sealing surface 43 and continuous from the fitting space 28 to the communication spaces 35 and the accommodation space 29 on a side opposite to the sealing surface 43 across the steps 46 (see FIGS. 4 and 9).

As shown in FIG. 9, the plate lock 44 includes a plate-like lock piece 48 cantilevered rearward from the step 46 and extending along the lateral direction on the inner surface of the body-side receptacle 30, a forward movement restricting portion 49 projecting in a laterally central part of a front part of the inner surface of the lock piece 48, which is a plate surface, and rearward movement restricting portions 50 projecting on left and right sides of a rear part of the inner surface of the lock piece 48, which is the plate surface.

The lock piece 48 is deflectable and deformable inward and outward with a part coupled to the step portion 46 as a fulcrum. As shown in FIG. 4, spaces between the continuous surface 47 and the lock piece portions 48 of the body-side receptacle 30 serve as deflection spaces 51 into which the lock piece portions 48 are deflected and deformed, and communicate with the fitting space 28.

As shown in FIGS. 4 and 9, the forward movement restricting portion 49 is a thick part projecting from the front end to a central part in the front-rear direction of the lock piece 48, the front surface thereof is tapered to incline rearward and the rear surface thereof is arranged substantially along the vertical direction. Left and right rearward movement restricting portions 50 project in a rear part of the lock piece 48, and the front surfaces thereof are tapered reversely tapered to incline forward toward tips. An interval between the rear surface of the forward movement restricting portion 49 and the front surfaces of the rearward movement restricting portions 50 corresponds to a thickness of a later-described plate body 62 of the moving plate 14.

The front surfaces of the forward movement restricting portions 49 and the rearward movement restricting portions 50 are formed by an unillustrated mold pulled out forward at the time of molding. A pull-out space formed due to the passage of this mold is constituted by the fitting space 28 inside the sealing surface 43. As shown in FIG. 7, when the housing unit 32 is viewed from front, the forward movement restricting portions 49 and the rearward movement restricting portions 50 can be visually confirmed through the fitting space 28.

The rear surfaces of the plate locks 44 including the respective rear surfaces of the forward movement restricting portions 49 and the rearward movement restricting portions 50 are formed by an unillustrated mold pulled out rearward at the time of molding. A pull-out space formed due to the passage of this mold is constituted by the fitting space 28, the communication spaces 35 and the accommodation space 29. As shown in FIG. 8, when the housing unit 32 is viewed from behind, the rear surfaces of the plate lock portions 44 and the deformation spaces 51 can be visually confirmed through the accommodation space 29, the communication spaces 35 and the fitting space 28.

The temporary pedestals 45 are arranged at intervals in the circumferential direction in ranges from left and right sides to upper and lower sides of the inner surface of the body-side receptacle 30. As shown in FIG. 9, each temporary pedestal 45 is in the form of a rib extending in the front-rear direction, and the front end thereof is at substantially the same position as the step 46 in the front-rear direction to define the rear end of the sealing surface 43. As shown in FIG. 16, the sealing member 16 is arranged such that the rear end thereof can contact the front ends of the respective temporary pedestal portions 45 while being held in close contact with the sealing surface 43. Further, as shown in FIGS. 3 and 4, a mounting portion 82 to which an unillustrated bracket is slidably mounted projects on the lower surface of the housing unit 32. The male connector 10 including the housing unit 32 is mounted on the bracket via the mounting portion 82.

The tip-side receptacle 31 projects continuously forward of the housing unit 32. As shown in FIGS. 2 and 3, the tip-side receptacle 31 includes a flat tubular receptacle body 52 penetrating in the front-rear direction, the coupling arms 53 provided on the outer surfaces of the upper and lower walls of the receptacle body 52 and a lock structure 54 projecting on the outer surface of a side wall of the receptacle body 52.

Figure 6:
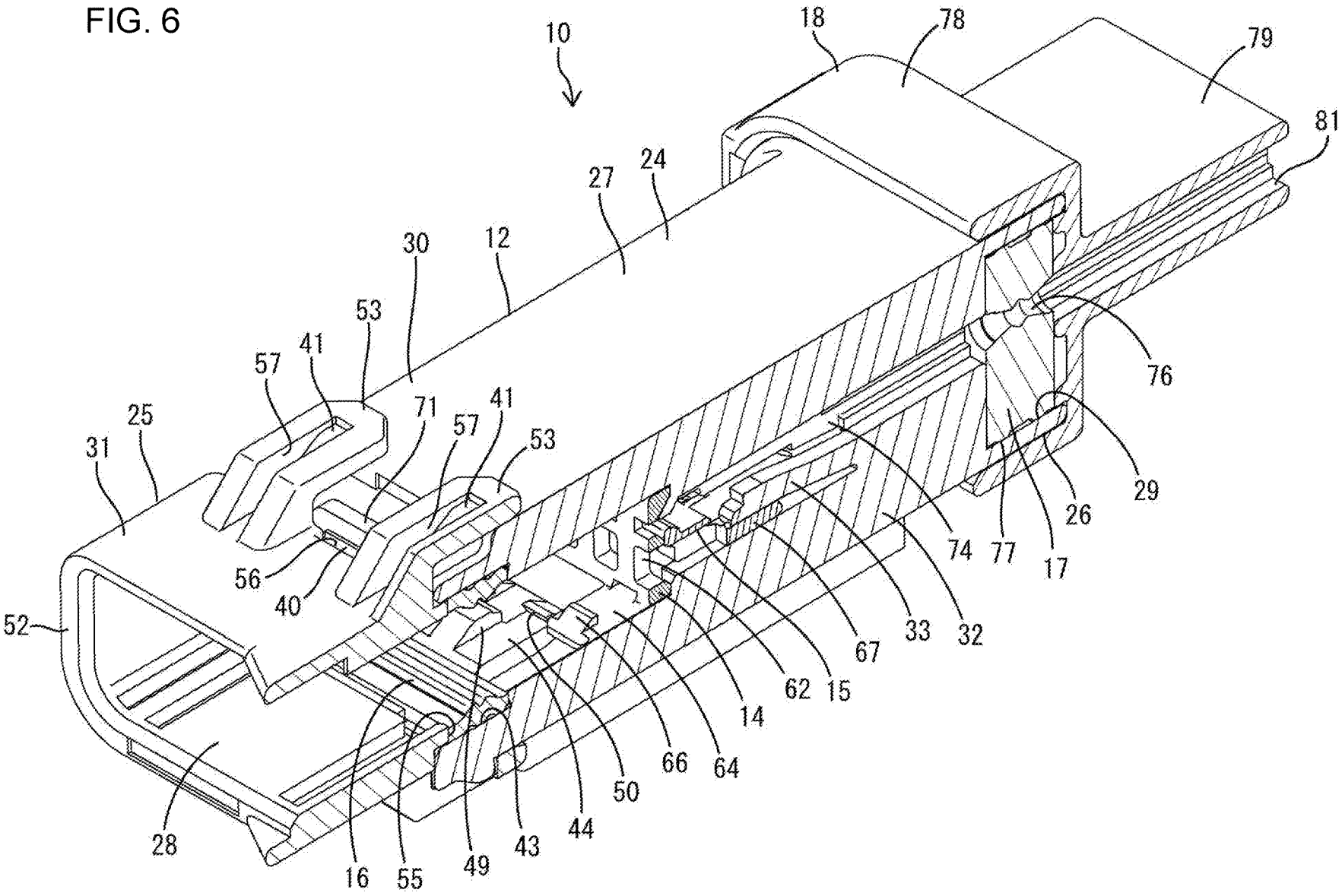
FIG. 6 is a perspective view in section of the male connector along the front-rear direction when the moving plate is at a retracted position.

As shown in FIGS. 4 to 6, the sealing member 16 is sandwiched in the front-rear direction between the tip-side receptacle 31 and the body-side receptacle 30. A rear end of the receptacle body 52 has a contact surface 55 along the circumferential direction. The contact surface 55 contacts the front end of the sealing member 16 to restrict forward escape of the sealing member 16. The receptacle body 52 includes recesses 56 recessed forward from the contact surface 55 in laterally central parts of the rear ends of the upper and lower walls. With the tip-side receptacle 31 coupled to the body-side receptacle 30, tips of the locking protrusions 40 passed through lock receiving portions 72 of later-described locking pieces 71 of the sealing member 16 enter the recesses 56 to escape (see FIG. 4).

The coupling arms 53 are paired in vertical and lateral directions on left and right sides across the recesses 56 on outer surfaces of the upper and lower walls of the receptacle body 52 (see FIG. 3). Each coupling arm 53 is a frame cantilevered rearward from a rear part of the outer surface of the upper or lower wall of the receptacle body 52 and includes a coupling hole 57 in the form of a slit long in the front-rear direction inside as shown in FIG. 2. The tip-side receptacle 31 and the body-side receptacle 30 are held coupled by fitting the coupling projections 41 into the coupling holes 57 of the coupling arms 53.

As shown in FIGS. 1 to 3, the lock structure 54 includes the arm-like lock 58 resiliently inclinable and displaceable in a seesaw manner with respect to a side wall of the receptacle body 52 and a protecting portion 59 in the form of a rectangular frame surrounding the lock 58 (from upper, lower and lateral sides). As shown in FIG. 16, the lock 58 resiliently locks the lock receiving portion 111 when the connection of the connectors 10, 100 is completed. The protecting portion 59 functions to protect the lock 58 so that an inadvertent operation force is not applied to the lock 58. Further, the inside of the protecting portion 59 functions as a moving space of the detecting member 13.

Detecting Member 13

The detecting member 13 is made of synthetic resin and is a plate insertable into the protecting portion 59 (see FIG. 1). The detecting member 13 is movable to a standby position and a detecting position with respect to the protecting portion 59. A deflectable detection arm 60 projects forward and engages the lock 58 at the standby position and the detecting position, (see FIG. 16). The detecting member 13 is held at the standby position in the protecting portion 59 of the male housing 12 before the connection of the connectors 10, 100 and is allowed to move to the detecting position after the connection of the connectors 10, 100 is completed. On the other hand, movement of the detecting member 13 to the detecting position is restricted if the connectors 10, 100 are not connected properly. Thus, proper connection of the connectors 10, 100 can be detected if the detecting member 13 is movable to the detecting position and improper connection of the connectors 10, 100 is detected if the detecting member 13 cannot be moved to the detecting position.

Moving Plate 14

The moving plate 14 is made of synthetic resin and is arranged in the fitting space 28 of the body-side receptacle 30 for movement in the front-rear direction between a protecting position and a retracted position. The moving plate 14 is at the protecting position when the connectors 10, 100 are not connected (see FIG. 4) and is at the retracted position when the connectors 10, 100 are connected (see FIG. 15). As shown in FIGS. 1 and 14, the moving plate 14 includes the wide vertically aligned plate body 62, plate lock receiving portions 63 in laterally central parts of the upper and lower ends of the plate body 62 and arms 64 on both sides across the plate lock receiving portions 63 on the upper and lower ends of the plate body 62. The plate body 62 includes positioning holes 64 at positions corresponding to the respective cavities 74. As shown in FIGS. 4 and 5, at the protecting position, the plate body 62 is separated forward from a front of the housing body 23 and has the tips of the tabs 20 inserted into the positioning holes 65 to protect the tabs 20. On the other hand, at the retracted position, the plate body 62 is near the front surface side of the housing body 23 and has base end parts of the tabs 20 inserted into the positioning holes 65 to allow the insertion and connection of the tabs 20 to the connecting portions 106, as shown in FIG. 15.

The plate lock receiving portions 63 are claws paired in the vertical and lateral directions of the plate body 62, as shown in FIG. 14. As shown in FIG. 4, the rear surfaces of the plate lock receiving portions 63 are reversely tapered to incline rearward toward tips, to contact the front surfaces of the rearward movement restricting portions 50 of the plate lock portions 44 and to restrict a rearward movement of the moving plate 14 at the protecting position to the retracted position. The front surfaces of the plate lock receiving portions 63 are tapered to incline rearward toward tips. Laterally central parts of the front surface of the plate body 62 between the left and right plate lock receiving portions 63 come into contact with the rear surfaces of the forward movement restricting portions 49 of the plate locks 44 to restrict a forward movement of the moving plate 14 from the protecting position.

Each arm 64 has a base end part projecting on the upper or lower end of the plate body 62, is cantilevered forward from the base end part, and includes the claw-like locking projection 66 projecting in on a front tip. Each arm 64 is deflectable and deformable inward and outward with the base end part as a fulcrum. The locking projection 66 has a projecting dimension equal to or slightly smaller than a depth of the recess 112 of the female housing 102 (see FIG. 15). The rear surface of the locking projection 66 is tapered reversely to incline rearward toward a tip, is locked to the locking edge 114 of the recess 112, and enables the moving plate 14 at the retracted position to return to the protecting position in conjunction with a separating operation of the female housing 102 by maintaining that locking state.

Retainer 15 of Male Connector 10

The retainer 15 is made of synthetic resin, has a wide flat shape, as shown in FIG. 1 and is accommodated entirely into the lower space of the front part of the housing body 23, as shown in FIG. 4. The retainer 15 includes plate-like detecting pieces 67 at positions corresponding to the cavities 74. The detecting pieces 67 function similarly to the detecting pieces 117 of the female connector 100 and have a function of detecting incomplete insertion of the male terminal fittings 11 and a function of restricting the deflection of the locking lances 33. Detailed description of the detecting pieces 67 is omitted.

Sealing Member 16

Figure 12:
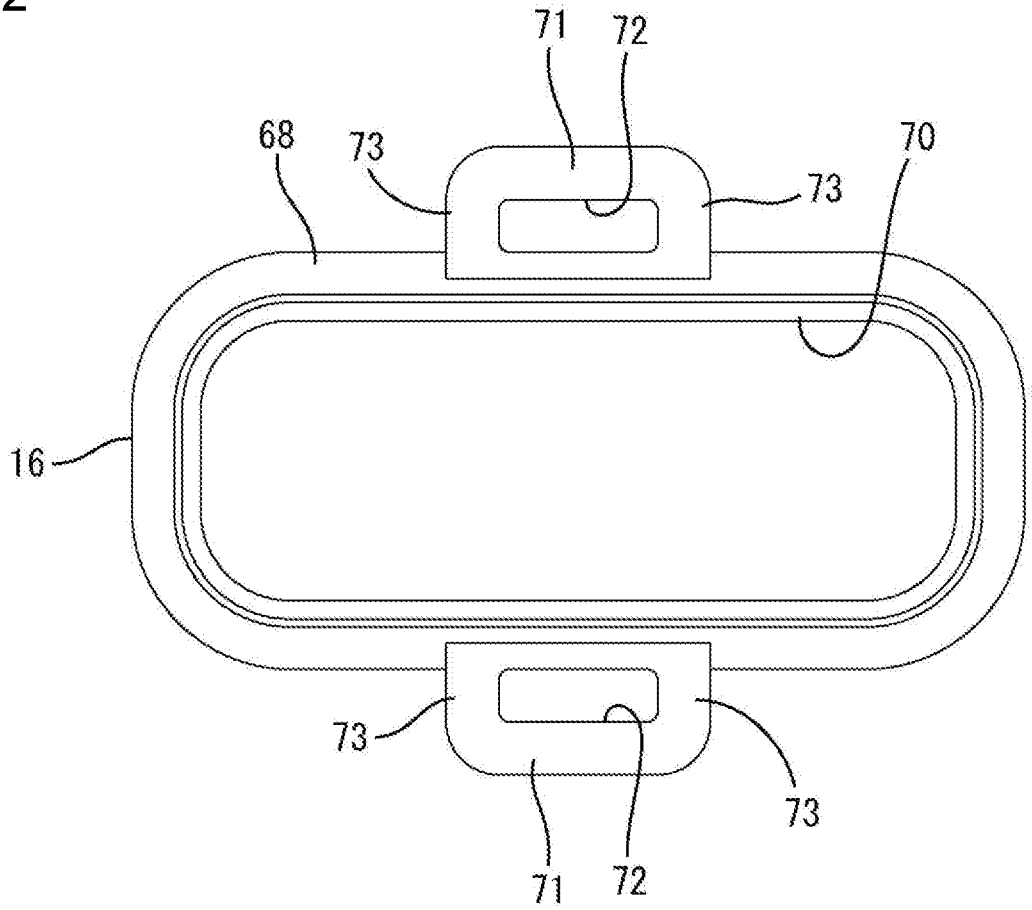
FIG. 12 is a front view of a sealing member.
Figure 13:
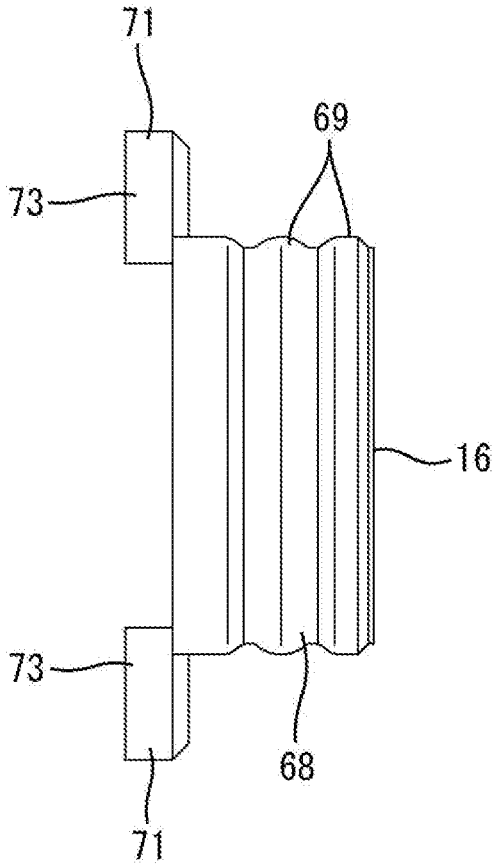
FIG. 13 is a side view of the sealing member.

The sealing member 16 is a ring made of rubber such as silicon rubber and is mounted into the fitting space 28 of the male connector 10 in advance before connection of the connectors 10, 100 so that the outer surface thereof closely contacts the sealing surface 43 of the body-side receptacle 30 (see FIGS. 4 to 6). After connection of the connectors 10, 100, the sealing member 16 is sandwiched radially between the sealing surfaces 43, 116 of the connectors 10, 100 to hold the connectors 10, 100 in a liquid-tight manner (see FIG. 15). As shown in FIGS. 12 and 13, the sealing member 16 includes a wide ring body 68 that is short in the vertical direction with four curved corners. The ring body 68 has a front-rear dimension corresponding to a dimension of the sealing surface 43 in the front-rear direction. Outer peripheral lips 69 are side by side in the front-rear direction and extend circumferentially on the outer surface of the ring body 68. Inner peripheral lips 70 are side by side in the front-rear direction and extend circumferentially on the inner surface of the ring body 68. As shown in FIG. 4, the outer peripheral lips 69 and the inner peripheral lips 70 are shifted in phase in the front-rear direction.

As shown in FIGS. 12 and 13, the sealing member 16 includes the locking pieces 71 projecting in laterally central areas of the front ends of upper and lower parts (long sides) of the ring body 68 and projecting out (up and down) substantially along the vertical direction from the base end parts. Each locking piece 71 is in the form of a frame and includes the lock receiving portion 72 penetrating in the front-rear direction. The lock receiving portion 72 is a wide slit hole and, as shown in FIG. 4, the locking protrusion 40 is inserted therein. With the locking protrusion 40 inserted in the lock receiving portion 72, left and right legs 73 of the locking piece 71 are inserted into the corresponding slits 39.

Sealing Plug 17 of Male Connector 10

The sealing plug 17 is made of one piece of rubber, such as silicon rubber, and, as shown in FIG. 1, is a wide mat having a predetermined thickness in the front-rear direction. This sealing plug 17 is slightly larger than the outer shape of the sealing plug 103 of the female connector 100 and is thick in the vertical direction. Sealing hoes 76 penetrate the sealing plug 17 in the front-rear direction and are arranged side by side in a row at positions corresponding to the cavities 74. The wire 22 connected to the male terminal fitting 11 is inserted in the sealing holes 76 and held resiliently in close contact with lips formed on the inner periphery of the sealing hole 76 in a liquid-tight manner (see FIG. 4). Outer peripheral lips 77 are arranged side by side in the front-rear direction on the outer surface of the sealing plug 17. The sealing plug 17 is inserted into the accommodation space 29 of the outer peripheral portion 24 and the outer peripheral lips 77 are held in close contact with a rear part inner surface of the outer peripheral portion 24. In this way, a clearance between the sealing plug 17 and the outer peripheral portion 24 is held in a liquid-tight manner, the accommodation space 29 is closed and the communication spaces 35 do not communicate with an outer rear side (see FIG. 15).

Rear Holder 18 of Male Connector 10

The rear holder 18 is made of synthetic resin and includes, as shown in FIGS. 1, 2 and 4 to 6, a cap 78 having a tubular part projecting forward. A flat guide 79 projects rearward from a rear wall of the cap 78 and is flat along the width direction. The tubular part of the cap 78 is dimensioned to surround the outer periphery of the accommodating tube 26 and includes lock holes 80 in left and right side walls. By fitting and locking the holder locks 36 to the lock holes 80, as shown in FIGS. 2 and 16, after the tubular part of the cap 78 is deflected and deformed, the rear holder 18 is held on the outer peripheral portion 24. A front surface of the rear wall of the cap 78 is inserted into the accommodation space 29 and comes into contact with the rear surface of the sealing plug 17, thereby restricting the rearward escape of the sealing plug 17.

As shown in FIG. 16, the guide portion 79 includes a plurality of wire insertion holes 81 at positions corresponding to the respective cavities 74. The wire insertion holes 81 are arranged side by side in a row in the width direction in the guide portion 79 and communicate with the respective cavities 74 while penetrating through the rear wall of the cap 78. The wires 22 connected to the male terminal fittings 11 are inserted into the respective wire insertion holes 81. The wire insertion holes 81 are longer than the thickness of the sealing plug 17 in the front-rear direction. Radial loose movements of the wires 22 are suppressed with the wires 22 inserted in the wire insertion holes 81. Thus, even if the wire 22 vibrates, the vibration is unlikely to be transmitted to the sealing plug 17 and predetermined sealing by the sealing plug 17 can be maintained.

Male Connector 10

As described above, the male connector 10 is a multi-function connector structured such that the male terminal fittings 11, the moving plate 14, the retainer 15, the sealing member 16 and the sealing plug 17 are accommodated in the male housing 12, and enabling sealability between the both connectors 10, 100 and in the male connector 10 to be ensured and the male terminal fittings 11 to be reliably protected and retained. Particularly, the mounting of the sealing member 16 into the receptacle 25 of the male housing 12 can contribute to the miniaturization of the female connector 100 as described above.

Assembling Operation of Male Connector 10

In assembling the male connector 10, the sealing plug 17, the rear holder 18, the male terminal fittings 11 and the retainer 15 are assembled with the male housing 12, and the moving plate 14 is mounted at the protecting position. The moving plate 14 is restricted from moving in the front-rear direction at the protecting position by having the plate body 62 held between the forward movement restricting portions 49 and the rearward movement restricting portions 50 (see FIG. 4). In this case, the reversely tapered front surfaces of the rearward movement restricting portions 50 and the reversely tapered rear surfaces of the plate lock receiving portions 63 are locked to each other so that a rearward movement of the moving plate 14 from the protecting position to the retracted position is impeded reliably.

When the moving plate 14 is at the protecting position, the left and right arms 64 are arranged on left and right sides across the lock pieces 48 of the plate locks 44 and between the temporary pedestals 45 on the side walls of the body-side receptacle 30 (see FIG. 5 although only one side is shown). The front ends of the arms 64 face the steps 46 from behind and are arranged in front of the sealing surface 43. The front ends of the tabs 20 of the respective male terminal fittings 11 slightly project from the positioning holes 65 and are arranged behind the rear end of the sealing surface 43 in the front-rear direction.

Subsequently, the sealing member 16 is mounted into the body-side receptacle 30. The sealing member 16 is mounted to be held temporarily in the body-side receptacle 30 by fitting the locking protrusions 40 into the lock receiving portions 72 of the locking pieces 71, fitting the left and right legs 73 of the locking pieces 71 into the slits 39 and further resiliently holding the outer peripheral lips 69 in contact with the sealing surface 43. The rear surface of the sealing member 16 is arranged to contact the front ends of the respective temporary pedestals 45.

Subsequently, the tip-side receptacle 31 is coupled to the front end of the body-side receptacle 30. The tip-side receptacle 31 is coupled integrally in front of the body-side receptacle 30 by resiliently locking the respective coupling arms 53 to the corresponding coupling projections 41 (see FIGS. 2 to 7). When the tip-side receptacle 31 is coupled to the body-side receptacle 30, the contact surface 55 of the receptacle body 52 is arranged to contact the front end of the sealing member 16. The sealing member 16 is held in the male housing 12 with positional deviations in the front-rear direction restricted by locking and fixing the locking pieces 71 to the ring locking portions 38 (see FIG. 4) and sandwiching the ring body 68 between the contact surface 55 and the respective temporary pedestals 45 (see FIG. 16). Further, with the tip-side receptacle 31 coupled to the body-side receptacle 30, the left and right coupling arms 53 are arranged proximately on the left and right sides across the locking pieces 71 of the sealing member 16 to restrict lateral positional deviations of the locking pieces 71 (see FIGS. 2 and 3). Furthermore, since the left and right coupling arms 53 have a height larger than the projecting dimension of the locking pieces 71 and can cover the left and right sides of the locking pieces 71, the locking pieces 71 can be protected from external matter. In the above way, the male connector 10 is assembled.

Connecting/Separating Operation of Both Connectors 10, 100

Next, a connecting/separating operation of the both connectors 10, 100 is described.

At the time of connecting the connectors 10, 100, the female housing 102 is inserted into the fitting space 28 of the receptacle 25 of the male connector 10. The tip of the female housing 102 (front end of the female housing 102) is inserted into the fitting space 28 of the body-side receptacle 30 after passing through the fitting space 28 of the tip-side receptacle 31. In the process of inserting the female housing 102 into the body-side receptacle 30, the inner peripheral lips 70 slide in contact with the outer surface of the female housing 102. However, since the sealing member 16 is held firmly in the body-side receptacle 30 via the locking pieces 71, the sealing member 16 does not move rearward in the receptacle 25 in conjunction with an inserting operation of the female housing 102.

As the female housing 102 is inserted into the body-side receptacle 30, the locking projections 66 of the respective arms 64 interfere with the tip of the female housing 102 and the respective arms 64 are deflected and deformed outward. As the female housing 102 is inserted further, the respective arms 64 resiliently return to an original horizontal posture and the locking projections 66 enter the recesses 112 and are arranged to be lockable to the locking edges 114. Simultaneously with or after the entrance of the locking projections 66 into the recesses 112, the front end of the female housing 102 slides on rearward inclined slopes of the forward movement restricting portions 49 to deflect and deform the lock pieces 48 outward. By deflecting and deforming the lock pieces 48 outward, the rearward movement restricting portions 50 are separated from the plate lock receiving portions 63 to release the locked state with the plate lock receiving portions 63. This makes it possible for the moving plate 14 to move from the protecting position to the retracted position.

As the female housing 102 is further inserted, the moving plate 14 is pressed by the female housing 102 to move toward the retracted position. Further, the lock piece portions 48 reach positions corresponding to the recesses 112 and resiliently return to the original horizontal posture, and the forward movement restricting portions 49 enter the recesses 112.

When the female housing 102 is fit to a proper depth into the fitting space 28 of the receptacle 25, the moving plate 14 reaches the retracted position and is sandwiched between the female housing 102 and the housing body 23 (see FIGS. 15 and 16). The tabs 20 of the male terminal fittings 11 then enter the connecting portions 106 of the female terminal fittings 101 and the terminal fittings 11, 101 are connected electrically. Further, the inner peripheral lips 70 of the sealing member 16 are held in close contact with the sealing surface 116 of the female housing 102 and a clearance between the receptacle 25 and the female housing 102 is held in a liquid-tight manner. Furthermore, if the female housing 102 is fit to the proper depth into the fitting space 28 of the receptacle 25, the lock receiving portion 111 is locked resiliently to the lock portion 58 and the connectors 10, 100 are held in the connected state. Thereafter, the detecting member 13 is moved to the detecting position.

In separating the connectors 10, 100, after the detecting member 13 is returned to the standby position, the locked state of the lock 58 and the lock receiving portion 111 is released and, in that state, the female connector 100 is pulled out from the receptacle 25. In the process of separating the female housing 102 from the receptacle 25, the locking projections 66 of the arms 64 are maintained locked to the locking edges 114 of the recesses 112. Thus, the moving plate 14 moves toward the protecting position in a separating direction together with the female housing 102. Immediately before the moving plate 14 returns to the protecting position, the forward inclined slopes of the rear ends of the forward movement restricting portions 49 slide in contact with opening ends of the locking edges 114, the lock pieces 48 deflect and deform out and the forward movement restricting portions 49 exit from the recesses 112. The separating operation of the female housing 102 proceeds and the lock pieces 48 are displaced toward the moving plate 14 to resiliently return. Thus, the plate locks 44 lock the moving plate 14 in a movement restricted state again and the moving plate 14 is held at the protecting position. Thereafter, only the female connector 100 is pulled apart from the receptacle 25, thereby completing the separation of the connectors 10, 100.

Functions and Effects

As described above, the following functions and effects are achieved.

Since the sealing surface 116 and the recesses 112 are provided on the outer surface of the female housing 102 and a projection for returning the moving plate 14 to the protecting position and the sealing member 16 are not provided on this outer surface, the female connector 100 is not enlarged in the radial direction.

In the process of connecting the connectors 10, 100, the sealing member 16 in the fitting space 28 of the receptacle 25 is not strongly interfered with since the recesses 112 are recessed inwardly on a more forward side than the sealing surface 116 in the connecting direction. Thus, damage of the sealing member 16 is not damaged and sealing ensured.

In the process of separating the connectors 10, 100, the locking projections 66 are locked to the side surfaces of the recesses 112. Thus, the moving plate 14 can be moved in conjunction with the separation of the female housing 102 from the receptacle 25 and the moving plate 14 can be returned from the retracted position to the protecting position.

Thus, the watertightness of the male connector 10 and a predetermined operation of the moving plate 14 can be ensured while the female connector 100 is miniaturized.

At the time of connecting the connectors 10, 100, the plate locks 44 are arranged to correspond to the recesses 112 and the recesses 112 can have both a function of locking the locking projections 66 and a function of allowing the plate lock portions 44 to escape. Thus, the configuration of the female housing 102 can be simplified as compared to the case where both functions are provided separately.

Further, the receptacle 25 is formed by separably uniting the body-side receptacle 30 and the tip-side receptacle 31 and the sealing member 16 is fixed by being sandwiched between the body-side receptacle 30 and the tip-side receptacle 31. Thus, even if the receptacle 25 is provided with structures such as the plate locks 44, the sealing member 16 can be mounted into the receptacle 25 without any trouble by mounting the sealing member 16 in the body-side receptacle 30 in advance.

Furthermore, the tip-side receptacle 31 is not a dedicated component for merely restricting the escape of the sealing member 16, but includes the lock structure 54 such as the lock 58. Thus, the lock structure 54 is not provided on the body-side receptacle 30 and a degree of freedom in the configuration of the body-side receptacle 30 can be enhanced.

Further, in molding the plate locks 44, the accommodation space 29 and the communication spaces 35 of the outer peripheral portion 24 can be utilized as a mold removal space for pulling out the molds, and the plate locks 44 can be formed without any trouble. The mold removal space is closed by the sealing plug 17 in the accommodation space 29 of the outer peripheral portion 24, and water intrusion into the male housing 12 can be prevented to ensure predetermined sealing by holding the outer peripheral lips 77 of the sealing plug 17 in close contact with the inner surface of the outer peripheral portion 24.

Since the body-side receptacle 30 and the tip-side receptacle 31 are held in the coupled state by the coupling arms 53 arranged on the left and right sides across the locking pieces 71 of the sealing member 16, the locking pieces 71 are positioned by the left and right coupling arms 53 and the locked state of the locking pieces 71 and the ring locking portions 38 can be maintained stably. Further, the locking protrusions 40 of the ring locking portions 38 are positioned and inserted into the lock receiving portions 72 of the locking pieces 71 so that the locked state of the locking pieces 71 and the ring locking portions 38 can be maintained more stably and reliably.

Other embodiments are briefly described below.

Although the forward movement restricting portions and the rearward movement restricting portions are provided on the lock pieces of the plate lock portions in the above embodiment, the forward movement restricting portions and the rearward movement restricting portions may be provided on separate lock parts.

Although the lock receiving portion is in the form of a bottomless hole penetrating the locking piece in the thickness direction in the above embodiment, the lock receiving portion may be a bottomed hole open only in the rear surface of the locking piece (surface on a side from which the locking protrusion is inserted) in the case of the present invention.

The lock provided on the tip-side receptacle may be a projection and the lock receiving portion provided on the female housing may be in the form of an arm.

Contrary to the above embodiment, the ring locking portions may be provided on the tip-side receptacle and the sealing member may be held in the tip-side receptacle by the ring locking portions before the connection of the connectors.

The coupling projections may be on the tip-side receptacle and the coupling arms may be provided on the body-side receptacle to project toward the tip-side receptacle.

LIST OF REFERENCE SIGNS

10 . . . male connector
11 . . . male terminal fitting
12 . . . male housing
14 . . . moving plate
16 . . . sealing member
17 . . . sealing plug (of male connector)
19 . . . terminal body
20 . . . tab
22 . . . wire (on male connector side)
23 . . . housing body
24 . . . outer peripheral portion
25 . . . receptacle
28 . . . fitting space
29 . . . accommodation space
30 . . . body-side receptacle
31 . . . tip-side receptacle
35 . . . communication space
38 . . . ring locking portion
40 . . . locking protrusion
44 . . . plate lock
48 . . . lock piece
53 . . . coupling arm
58 . . . lock
64 . . . arm
66 . . . locking projection
71 . . . locking piece
72 . . . lock receiving portion
100 . . . female connector
102 . . . female housing
112 . . . recess
116 . . . sealing surface (of female connector)

What is claimed is:

1. A connector, comprising:

a male terminal fitting including a tab;

a receptacle including a fitting space, the tab being arranged to project into the fitting space;

a plate lock provided in the receptacle to project into the fitting space;

a moving plate arranged movably from a protecting position to a retracted position in the fitting space and configured to position and protect a tip of the tab by being locked by the plate lock and held in a movement restricted state at the protecting position; and a sealing member arranged closer to an opening of the fitting space than the moving plate and configured such that an outer surface is held in close contact with an inner surface of the receptacle and an inner surface is held in close contact with an outer surface of a mating female housing;

wherein:

the receptacle is composed of a body-side receptacle including the plate lock and a tip-side receptacle arranged closer to the opening of the fitting space than the body-side receptacle and to be coupled to the body-side receptacle; and the sealing member is fixed by being sandwiched between the body-side receptacle and the tip-side receptacle, wherein either the body-side receptacle or the tip-side receptacle includes a ring locking portion, the sealing member includes a plate-like locking piece projecting radially outwardly of a body part of the sealing member and to be locked to the ring locking portion, and the body-side receptacle and the tip-side receptacle are held in a coupled state by coupling arms arranged on both widthwise sides across the locking piece.

2. The connector of claim 1, wherein:

the ring locking portion includes a locking protrusion, and the locking piece includes a bottomed or bottomless lock receiving portion, the locking protrusion being positioned and inserted into the lock receiving portion.

3. The connector of claim 2, wherein the tip-side receptacle includes a lock configured to lock the female housing and hold the female housing in a connected state.

4. The connector of claim 1, wherein the tip-side receptacle includes a lock configured to lock the female housing and hold the female housing in a connected state.

5. A connector, comprising:

a male housing having a receptacle including a fitting space and further having a plate lock projecting into the fitting space;

a male terminal fitting mounted in the housing and including a tab projecting into the fitting space;

a moving plate arranged in the fitting space for movement from a protecting position to a retracted position and being locked by the plate lock and held in a movement restricted state at the protecting position, the moving plate having a fitting hole into which a tip of the tab is inserted when the moving plate is at the protecting position to position and protect the tab, the tab projecting farther through the fitting hole as the moving plate is moved to the retracted position; and a sealing member arranged closer to an opening of the fitting space than the moving plate and configured such that an outer surface of the sealing member is held in close contact with an inner surface of the receptacle and an inner surface of the sealing member is held in close contact with an outer surface of a mating female housing;

wherein:

the receptacle is composed of a body-side receptacle including the plate lock and a tip-side receptacle coupled to the body-side receptacle and arranged closer to the opening of the fitting space than the body-side receptacle; and the sealing member is fixed by being sandwiched between the body-side receptacle and the tip-side receptacle.

6. The connector of claim 5, wherein either the body-side receptacle or the tip-side receptacle includes a ring locking portion, the sealing member includes a plate-like locking piece projecting radially outwardly of a body part of the sealing member and to be locked to the ring locking portion, and the body-side receptacle and the tip-side receptacle are held in a coupled state by coupling arms arranged on both widthwise sides across the locking piece.

7. The connector of claim 6, wherein:

the ring locking portion includes a locking protrusion, and the locking piece includes a bottomed or bottomless lock receiving portion, the locking protrusion being positioned and inserted into the lock receiving portion.

8. The connector of claim 7, wherein the tip-side receptacle includes a lock configured to lock the female housing and hold the female housing in a connected state.

9. The connector of claim 5, wherein the tip-side receptacle includes a lock configured to lock the female housing and hold the female housing in a connected state.

* * * * *